US011721507B2

(12) United States Patent
Nishida et al.

(10) Patent No.: US 11,721,507 B2
(45) Date of Patent: Aug. 8, 2023

(54) CONTACT DEVICE

(71) Applicant: OMRON Corporation, Kyoto (JP)

(72) Inventors: Takeshi Nishida, Ibaraki (JP); Tatsuro Kato, Otsu (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/287,519

(22) PCT Filed: Oct. 16, 2019

(86) PCT No.: PCT/JP2019/040588

§ 371 (c)(1),
(2) Date: Apr. 22, 2021

(87) PCT Pub. No.: WO2020/100500

PCT Pub. Date: May 22, 2020

(65) Prior Publication Data

US 2021/0391134 A1 Dec. 16, 2021

(30) Foreign Application Priority Data

Nov. 16, 2018 (JP) ..... 2018-215494

(51) Int. Cl.
*H01H 3/00* (2006.01)
*H01H 50/54* (2006.01)
(Continued)

(52) U.S. Cl.
CPC ..... *H01H 50/546* (2013.01); *H01H 33/70* (2013.01); *H01H 50/02* (2013.01)

(58) Field of Classification Search
CPC ..... H01H 50/58; H01H 33/76; H01H 50/546; H01H 50/60; H01H 1/66; H01H 50/54; H01H 9/30–302; H01H 73/18
(Continued)

(56) References Cited

U.S. PATENT DOCUMENTS 5,574,624 A * 11/1996 Rennie ..... H02B 1/56 361/676
6,700,466 B1 * 3/2004 Yamamoto ..... H01H 9/302 335/201
(Continued)

FOREIGN PATENT DOCUMENTS

EP 2348521 A2 * 7/2011 ..... H01H 50/546
JP 60-21122 U 2/1985
(Continued)

OTHER PUBLICATIONS

The International Search Report of International Application No. PCT/JP2019/040588 dated Dec. 3, 2019.
(Continued)

*Primary Examiner* — Shawki S Ismail
*Assistant Examiner* — Lisa N Homza
(74) *Attorney, Agent, or Firm* — Shinjyu Global IP

(57) ABSTRACT

A housing includes a first space, a second space, a first hole, a second hole, and an arc extinguishing member. A fixed contact and a movable contact are arranged in the first space. The second space is partitioned from the first space. The first hole communicates the first space and the second space. The second hole communicates the second space with a space outside the second space. The arc extinguishing member releases an arc extinguishing gas into the first space. The second hole has a smaller opening area than the first hole.

9 Claims, 12 Drawing Sheets

(51) Int. Cl.
*H01H 33/70* (2006.01)
*H01H 50/02* (2006.01)

(58) Field of Classification Search
USPC ..... 335/185
See application file for complete search history.

(56) References Cited

U.S. PATENT DOCUMENTS 7,843,682 B2 * 11/2010 Leinen ..... H01H 9/047 361/652
8,093,974 B2 * 1/2012 Nagura ..... H01H 9/047 335/201
10,679,812 B2 * 6/2020 Tanaka ..... H01H 50/64
2004/0066261 A1 * 4/2004 Nishida ..... H01H 51/2209 335/179
2004/0080389 A1 * 4/2004 Nishida ..... H01H 50/026 335/132
2005/0072591 A1 * 4/2005 Hayase ..... H01H 50/14 174/667
2005/0146405 A1 * 7/2005 Nishida ..... H01H 50/36 335/132
2005/0148216 A1 * 7/2005 Nishida ..... H01H 9/48 439/74
2005/0156469 A1 * 7/2005 Nishida ..... H01H 9/443 310/40 MM
2006/0102593 A1 * 5/2006 Shea ..... H01H 77/104 218/7
2009/0179010 A1 * 7/2009 Asokan ..... H01H 9/342 218/157
2010/0191147 A1 * 7/2010 Miyoshi ..... A61B 5/150175 600/576
2016/0012995 A1 * 1/2016 Son ..... H01H 50/20 335/185
2022/0189720 A1 * 6/2022 Nishida ..... H01H 1/66

FOREIGN PATENT DOCUMENTS

JP 60-147135 U 9/1985
JP 61-193312 A 8/1986
JP 2016-24864 A 2/2016
JP 2017-117678 A 6/2017
KR 20140145143 A * 12/2014 ..... H01H 33/20
WO WO-2020100498 A1 * 5/2020 ..... H01H 1/66

OTHER PUBLICATIONS

The Written Opinion of International Searching Authority of International Application No. PCT/JP2019/040588 dated Dec. 3, 2019.
The Office Action of the corresponding Japanese application No. 2018-215494 dated Jul. 5, 2022.

* cited by examiner

CONTACT DEVICE

CROSS-REFERENCE TO RELATED APPLICATION

This application is the U.S. National Phase of International Application No. PCT/JP2019/040588, filed on Oct. 16, 2019. This application claims priority to Japanese Patent Application No. 2018-215494, filed Nov. 16, 2018. The contents of those applications are incorporated by reference herein in their entireties.

FIELD

The present invention relates to a contact device.

BACKGROUND

A contact device has a fixed contact and a movable contact. The movable contact moves between a contact position in contact with the fixed contact and an open position away from the fixed contact. When the movable contact separates from the fixed contact, an arc is generated between the contacts. Conventionally, for example, as in the contact device of Japanese Laid-Open Patent Publication No. 2016-24864, in order to quickly extinguish an arc, an arc extinguishing member is arranged in a storage space of the contact. The arc extinguishing member releases an arc extinguishing gas by the heat of the arc. The arc is extinguished by the arc extinguishing gas. Thereby, the breaking performance of the contact device can be improved.

SUMMARY

When an arc is generated at the contact, metal vapor is generated by melting the contact. When the storage space is filled with metal vapor, the insulation of the contacts is reduced. When the energy of the current cut off by the contact (hereinafter referred to as "breaking energy") is small, the amount of arc extinguishing gas released from the arc extinguishing member is small, and the pressure in the storage space is low. Therefore, the time until the arc is extinguished becomes long. Therefore, it is preferable to discharge the metal vapor from the storage space to ensure the insulation of the contacts. On the other hand, when the breaking energy is large, it is preferable to maintain a high pressure in the storage space in order to extinguish the arc more quickly. Therefore, the preferable environment in the storage space differs depending on the magnitude of the breaking energy.

An object of the present invention is to suitably adjust an environment in a space in which contacts are housed in a contact device according to a magnitude of breaking energy.

A contact device according to one aspect of the present invention includes a fixed contact, a movable contact, and a housing. The movable contact is configured to move between a contact position and an open position. The movable contact contacts the fixed contact at the contact position. The movable contact separates from the fixed contact at the open position. The housing includes a first space, a second space, a first hole, a second hole, and an arc extinguishing member. The fixed contact and the movable contact are arranged in the first space. The second space is partitioned from the first space. The first hole communicates the first space and the second space. The second hole communicates the second space with a space outside the second space. The arc extinguishing member releases an arc extinguishing gas into the first space. The second hole has a smaller opening area than the first hole.

In the contact device according to the present aspect, when the breaking energy is small, the metal vapor is discharged from the first space through the first hole. Thereby, the insulation between the contacts can be improved. Further, when the breaking energy is large, since the second hole has the opening area smaller than that of the first hole, the metal vapor discharged from the first hole and the arc extinguishing gas fill the second space. Therefore, the pressure in the first space can be maintained high. Thereby, the arc can be extinguished more quickly. As described above, in the contact device according to the present aspect, the environment in the first space in which the contacts are housed can be suitably adjusted according to the magnitude of the breaking energy.

The arc extinguishing member may be configured to open and close the first hole. In this case, the environment in the first space can be suitably adjusted by opening and closing the first hole by the arc extinguishing member.

The contact device may further include a support member. The support member may movably support the arc extinguishing member with respect to the first hole. In this case, the first hole can be opened and closed by operating the arc extinguishing member by the support member. The support member may have a spring property. In this case, the arc extinguishing member can be movably supported by the spring property of the support member.

The support member may urge the arc extinguishing member from a closed position where the first hole is closed to an open position where the first hole is opened. In this case, when the breaking energy is small, the arc extinguishing member is held in the open position by the urging force of the support member. Then, when the breaking energy is large, the arc extinguishing member moves to the closed position against the urging force of the support member due to the pressure in the first space.

The contact device may further include a holding mechanism. The holding mechanism may hold the arc extinguishing member in the closed position. In this case, when the arc extinguishing member is set to the closed position due to the large breaking energy, the arc extinguishing member can be held to the closed position by the holding mechanism.

The arc extinguishing member may change an opening degree of the first hole according to the pressure in the first space. In this case, the pressure in the first space can be finely adjusted by the arc extinguishing member. The arc extinguishing member may include a tapered portion that is at least partially arranged in the first hole. In this case, the size of a gap between the tapered portion and the first hole is changed according to the position of the arc extinguishing member with respect to the first hole. Thereby, the opening degree of the first hole can be adjusted.

The arc extinguishing member may be arranged to face a space between the movable contact and the fixed contact when the movable contact is at the open position. In this case, by arranging the arc extinguishing member close to the contact, the arc extinguishing gas can be generated near the contact. Thereby, the arc extinguishing performance can be improved. Further, when the breaking energy is large, the arc extinguishing member moves, so that the space between the arc extinguishing member and the contact can be widened. As a result, even if the arc extinguishing member is arranged close to the contact, it is possible to prevent the arc from staying between the contact and the arc extinguishing member. Thereby, the arc can be extinguished quickly.

The contact device may further include a valve body. The valve body may be configured to open and close the first hole. In this case, the environment in the first space in which the contacts are housed can be suitably adjusted by opening and closing the first hole by the valve body.

The contact device may include a support member. The support member may movably support the valve body with respect to the first hole. In this case, the first hole can be opened and closed by operating the valve body by the support member. The support member may have a spring property. In this case, the valve body can be movably supported by the spring property of the support member.

The support member may urge the valve body from a closed position where the first hole is closed to an open position where the first hole is opened. In this case, when the breaking energy is small, the valve body is held in the open position by the urging force of the support member. Then, when the breaking energy is large, the valve body moves to the closed position against the urging force of the support member due to the pressure in the first space. The valve body may change the opening degree of the first hole according to the pressure in the first space. In this case, the pressure in the first space can be finely adjusted by the valve body.

The housing may include a partition wall that partitions the first space. The arc extinguishing member may form at least a portion of the partition wall. In this case, the arc extinguishing gas can be discharged into the first space from the portion forming the partition wall.

DETAILED DESCRIPTION

Figure 1:
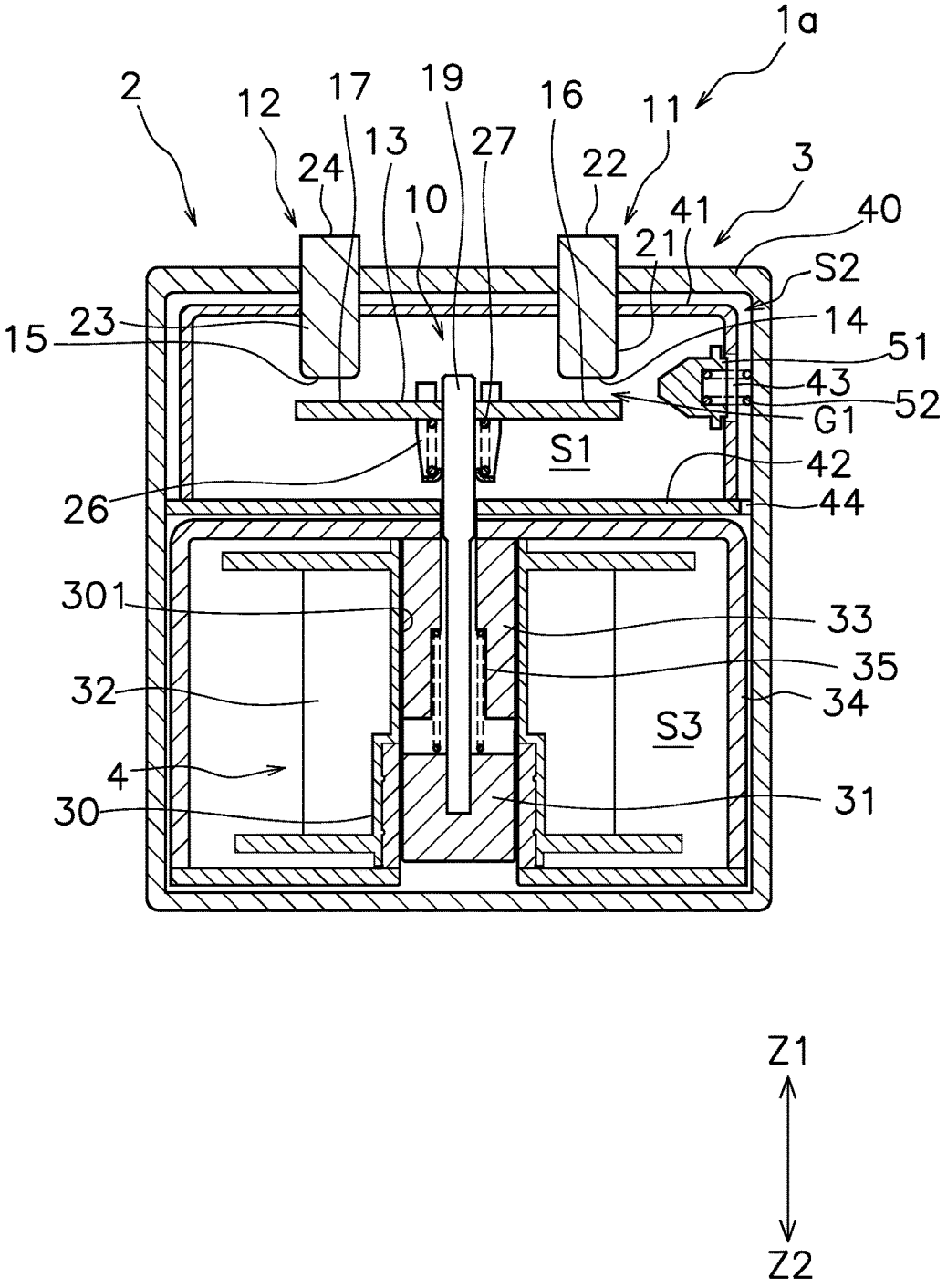
FIG. 1 is a side sectional view of a relay in an open state according to an embodiment.
Figure 2:
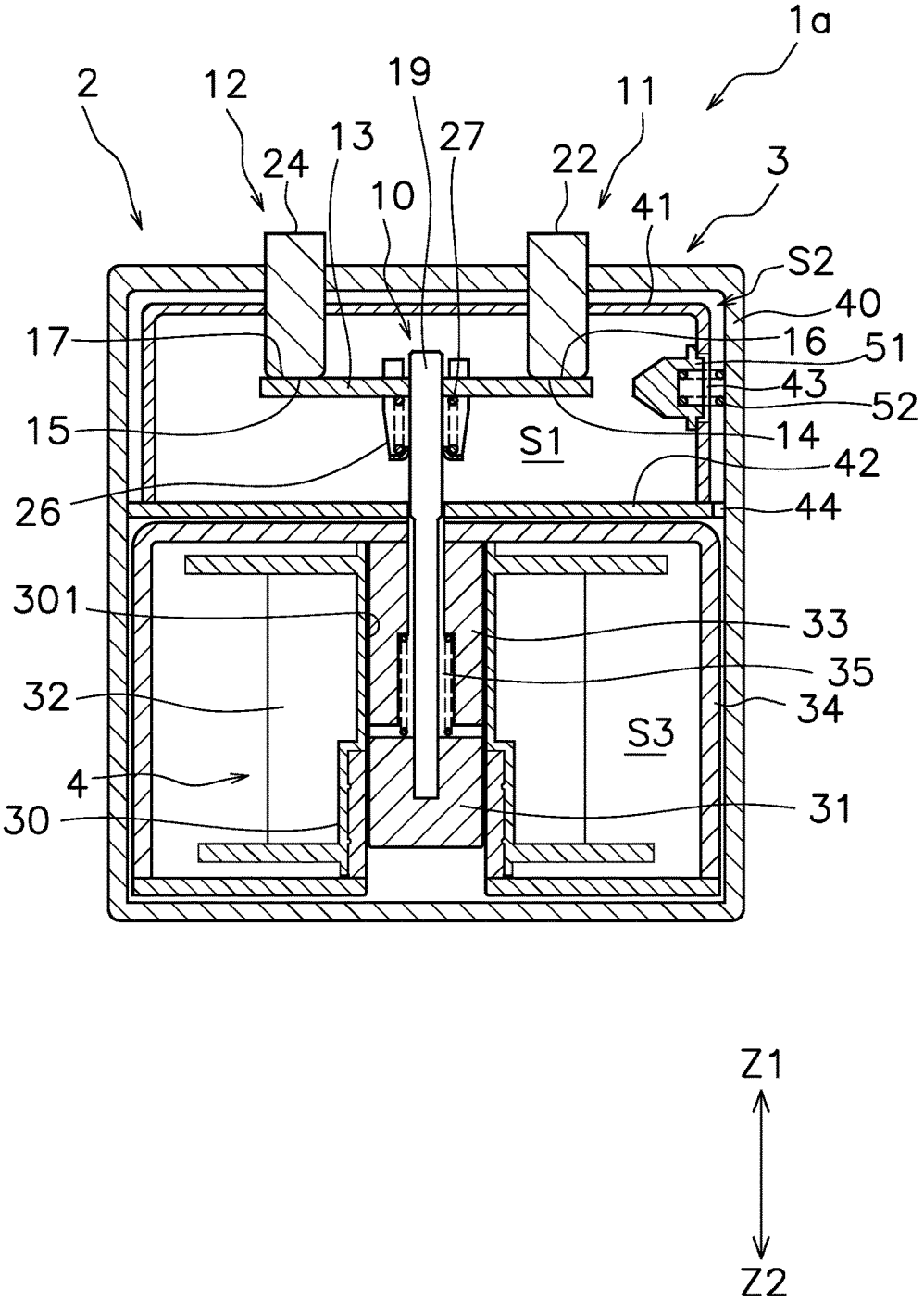
FIG. 2 is a side sectional view of the relay in a closed state.

Hereinafter, a relay 1*a* according to an embodiment will be described with reference to the drawings. FIG. 1 is a side sectional view showing the relay 1*a* according to the embodiment. As illustrated in FIG. 1, the relay 1*a* includes a contact device 2, a housing 3, and a drive device 4. In the following description, each direction of up, down, left, and right means each direction of up, down, left, and right in FIG. 1. Specifically, the direction from the drive device 4 to the contact device 2 is defined as upward. Further, the direction from the contact device 2 to the drive device 4 is defined as downward. In FIG. 1, a direction that intersects in the vertical direction is defined as a left-right direction. Further, the direction in which the vertical direction and the left-right direction intersect is defined as a front-back direction. The front-back direction is the direction perpendicular to the paper surface of FIG. 1. However, these directions are defined for convenience of explanation, and do not limit the arrangement direction of the relay 1*a*.

The contact device 2 includes a movable mechanism 10, a first fixed terminal 11, a second fixed terminal 12, a movable contact piece 13, a first movable contact 16, and a second movable contact 17. The first fixed terminal 11 and the second fixed terminal 12 are made of a conductive material such as copper. The first fixed terminal 11 is provided with a first fixed contact 14. The second fixed terminal 12 is provided with a second fixed contact 15. The first fixed contact 14 and the second fixed contact 15 are arranged apart from each other in the left-right direction.

The first fixed terminal 11 includes a first contact support portion 21 and a first external terminal portion 22. The first fixed contact 14 is connected to the first contact support portion 21. The first external terminal portion 22 is connected to the first contact support portion 21. The first external terminal portion 22 projects outward from the housing 3. The second fixed terminal 12 includes a second contact support portion 23 and a second external terminal portion 24. The second fixed contact 15 is connected to the second contact support portion 23. The second external terminal portion 24 is connected to the second contact support portion 23. The second external terminal portion 24 projects outward from the housing 3.

In FIG. 1, the first external terminal portion 22 and the second external terminal portion 24 project upward from the housing 3. However, the first external terminal portion 22 and the second external terminal portion 24 may project from the housing 3 not only in the vertical direction but also in other directions such as the left-right direction or the front-rear direction.

The movable contact piece 13 is made of a conductive material such as copper. The movable contact piece 13 extends in the left-right direction. In the present embodiment, the longitudinal direction of the movable contact piece 13 coincides with the left-right direction. The movable contact piece 13 is arranged to face the first fixed terminal 11 and the second fixed terminal 12 in the vertical direction.

The movable contact piece 13 is movably arranged in the contact direction Z1 and the separation direction Z2. The contact direction Z1 is a direction in which the movable contact piece 13 is close to the first fixed terminal 11 and the second fixed terminal 12 (upward in FIG. 1). The separation direction Z2 is a direction in which the movable contact piece 13 is separated from the first fixed terminal 11 and the second fixed terminal 12 (downward in FIG. 1).

The first movable contact 16 and the second movable contact 17 are supported by the movable contact piece 13. The first movable contact 16 and the second movable contact 17 are arranged apart from each other in the left-right direction. The first movable contact 16 faces the first fixed contact 14 in the vertical direction. The second movable contact 17 faces the second fixed contact 15 in the vertical direction.

The movable mechanism 10 is movably arranged in the contact direction Z1 and the separation direction Z2 together with the movable contact piece 13. The movable mechanism 10 includes a drive shaft 19, a holder 26, and a contact spring 27. The drive shaft 19 extends in the vertical direction. The drive shaft 19 is connected to the movable contact piece 13. The drive shaft 19 extends downward from the movable contact piece 13. The drive shaft 19 is connected to the movable contact piece 13 via the holder 26 and the contact spring 27. The holder 26 is attached to the movable contact piece 13 and holds the movable contact piece 13. The contact spring 27 is arranged between the holder 26 and the movable contact piece 13. The contact spring 27 urges the movable contact piece 13 in the contact direction Z1 in a state where the movable contacts 16 and 17 contact the fixed contacts 14 and 15.

The housing 3 houses the contact device 2 and the drive device 4. The housing 3 includes a first space S1, a second space S2, and a third space S3. The fixed contacts 14 and 15, the movable contact piece 13 and the movable contacts 16 and 17 are arranged in the first space S1. The drive device 4 is arranged in the third space S3.

The housing 3 includes a case 40, a first partition wall 41, and a second partition wall 42. The first partition wall 41 and the second partition wall 42 are arranged in the case 40. The first space S1 and the second space S2 are partitioned by the first partition wall 41. The first space S1 and the third space S3 are partitioned by the second partition wall 42. Further, the second space S2 and the third space S3 are separated by the second partition wall 42. However, the second space S2 and the third space S3 may be partitioned by a partition wall different from the second partition wall 42.

The drive device 4 operates the movable contact piece 13 by an electromagnetic force. The drive device 4 moves the movable contact piece 13 in the contact direction Z1 and the separation direction Z2. The drive device 4 includes a spool 30, a movable iron core 31, a coil 32, a fixed iron core 33, a yoke 34, and a return spring 35.

The spool 30 includes a hole 301 that extends through the spool 30 in the vertical direction. The movable iron core 31 is arranged in the hole 301 of the spool 30. The movable iron core 31 is provided separately from the fixed iron core 33. The movable iron core 31 is connected to the drive shaft 19. The movable iron core 31 is configured to move in the contact direction Z1 and the separation direction Z2. The coil 32 is wound around the spool 30. The coil 32 generates an electromagnetic force that moves the movable iron core 31 in the contact direction Z1 when energized.

The fixed iron core 33 is arranged in the hole 301 of the spool 30. The fixed iron core 33 is arranged to face the movable iron core 31. The return spring 35 is arranged between the movable iron core 31 and the fixed iron core 33. The return spring 35 urges the movable iron core 31 in the separation direction Z2.

The yoke 34 is arranged to surround the coil 32. The yoke 34 is arranged on a magnetic circuit formed by the coil 32. The yoke 34 is arranged above the coil 32, to the sides of the coil 32, and below the coil 32.

Next, the operation of the relay 1*a* will be described. When the coil 32 is not energized, the drive device 4 is not magnetized. In this case, the drive shaft 19 is pressed together with the movable iron core 31 in the separation direction Z2 by the elastic force of the return spring 35. Therefore, the movable contact piece 13 is also pressed in the separation direction Z2, and the movable contacts 16 and 17 are located at the open position illustrated in FIG. 1. When the movable contacts 16 and 17 are located at the open position, the first movable contact 16 and the second movable contact 17 are separated from the first fixed contact 14 and the second fixed contact 15.

When the coil 32 is energized, the drive device 4 is magnetized. In this case, the movable iron core 31 moves in the contact direction Z1 against the elastic force of the return spring 35 due to the electromagnetic force of the coil 32. As a result, the drive shaft 19 and the movable contact piece 13 both move in the contact direction Z1, and the movable contacts 16 and 17 move to the contact position illustrated in FIG. 1. When the movable contacts 16 and 17 are located at the contact position, the first movable contact 16 and the second movable contact 17 contact the first fixed contact 14 and the second fixed contact 15, respectively.

When the current to the coil 32 is stopped and the coil is demagnetized, the movable iron core 31 is pressed in the separation direction Z2 by the elastic force of the return spring 35. As a result, both the drive shaft 19 and the movable contact piece 13 move in the separation direction Z2, and the movable contacts 16 and 17 return to the open position illustrated in FIG. 1.

Figure 3:
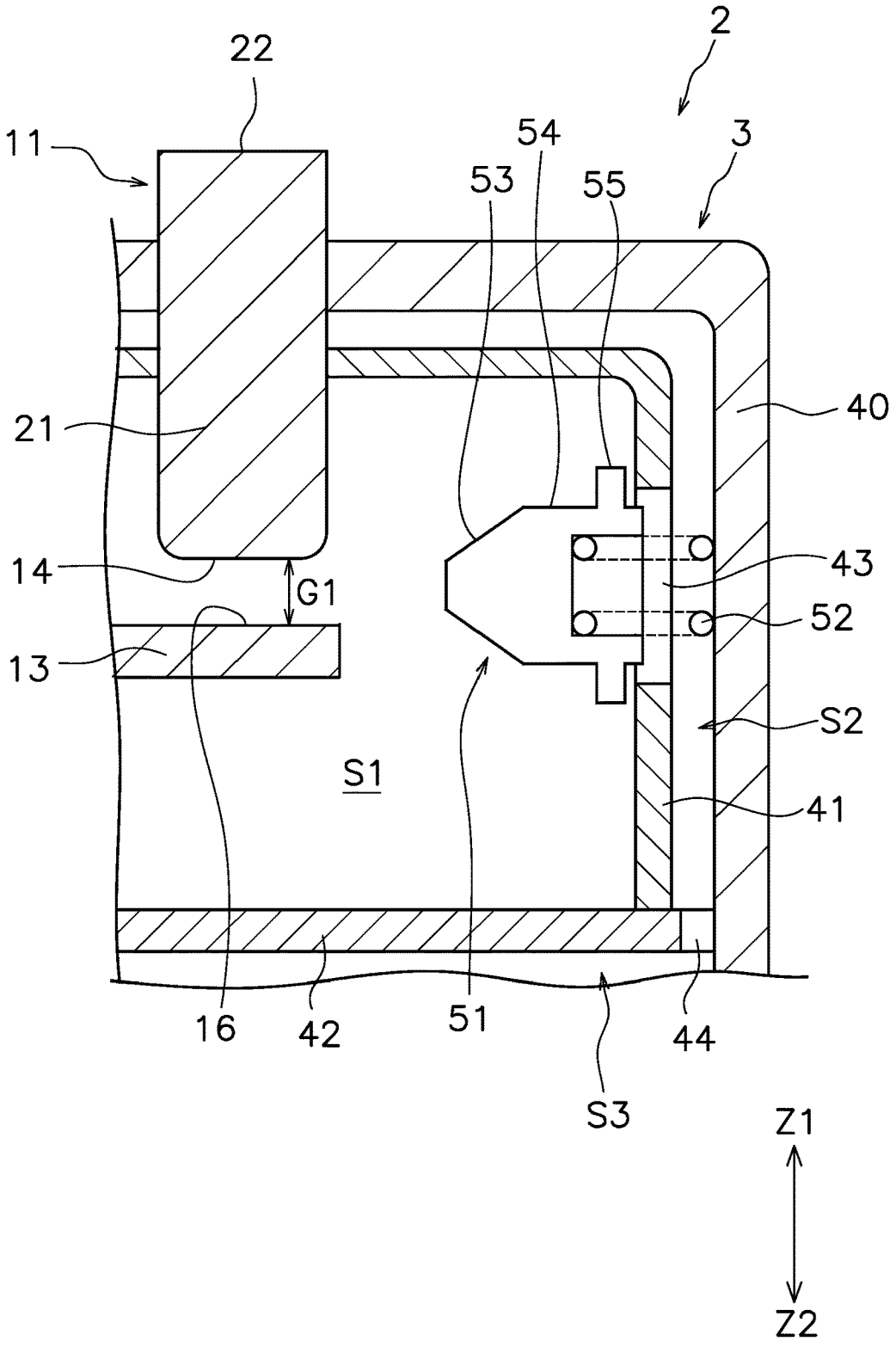
FIG. 3 is an enlarged view of a contact device.

FIG. 3 is an enlarged view showing a part of the contact device 2. As illustrated in FIG. 3, the housing 3 includes a first hole 43 and a second hole 44. The first hole 43 is provided in the first partition wall 41. The first hole 43 communicates the first space S1 and the second space S2. The first hole 43 is arranged to face a gap G1 (hereinafter, referred to as "first gap G1") between the first fixed contact 14 and the first movable contact 16. However, the first hole 43 may be arranged at another position. The second hole 44 is provided in the second partition wall 42. The second hole 44 communicates the second space S2 and the third space S3. The second hole 44 is arranged at a position not facing the first hole 43. The second hole 44 has an opening area smaller than that of the first hole 43. The opening area means the projected area of the hole in the communication direction of the hole.

The contact device 2 includes an arc extinguishing member 51 and a support member 52. At least a part of the arc extinguishing member 51 is arranged in the first space S1. The arc extinguishing member 51 releases an arc extinguishing gas. The arc extinguishing member 51 is made of a material that releases an arc extinguishing gas by the heat of the arc. The arc extinguishing gas is, for example, a gas containing hydrogen or nitrogen as a main component, and can extinguish the arc. Alternatively, the arc extinguishing gas is not limited to a gas containing hydrogen or nitrogen as a main component, and may be a gas containing other elements as a main component.

The arc extinguishing member 51 may be made of a material such as a phenol resin, a hydrogen storage metal, or titanium hydride. Alternatively, the arc extinguishing member 51 may be made of, for example, a thermosetting resin such as an unsaturated polyester resin or a melamine resin. Alternatively, the arc extinguishing member 51 may be made of a thermoplastic resin such as a polyolefin resin, a polyamide resin, or a polyacetal resin. Alternatively, the arc extinguishing member 51 may be made of another material.

The arc extinguishing member 51 is arranged to face the first gap G1 when the movable contacts 16 and 17 are in the open position. The arc extinguishing member 51 includes a shape that tapers toward the first gap G1. The arc extinguishing member 51 is connected to the housing 3 via the support member 52. The arc extinguishing member 51 projects from the first partition wall 41 toward the first gap G1. The arc extinguishing member 51 is arranged to face the first hole 43. The arc extinguishing member 51 is configured to open and close the first hole 43.

Figure 4:
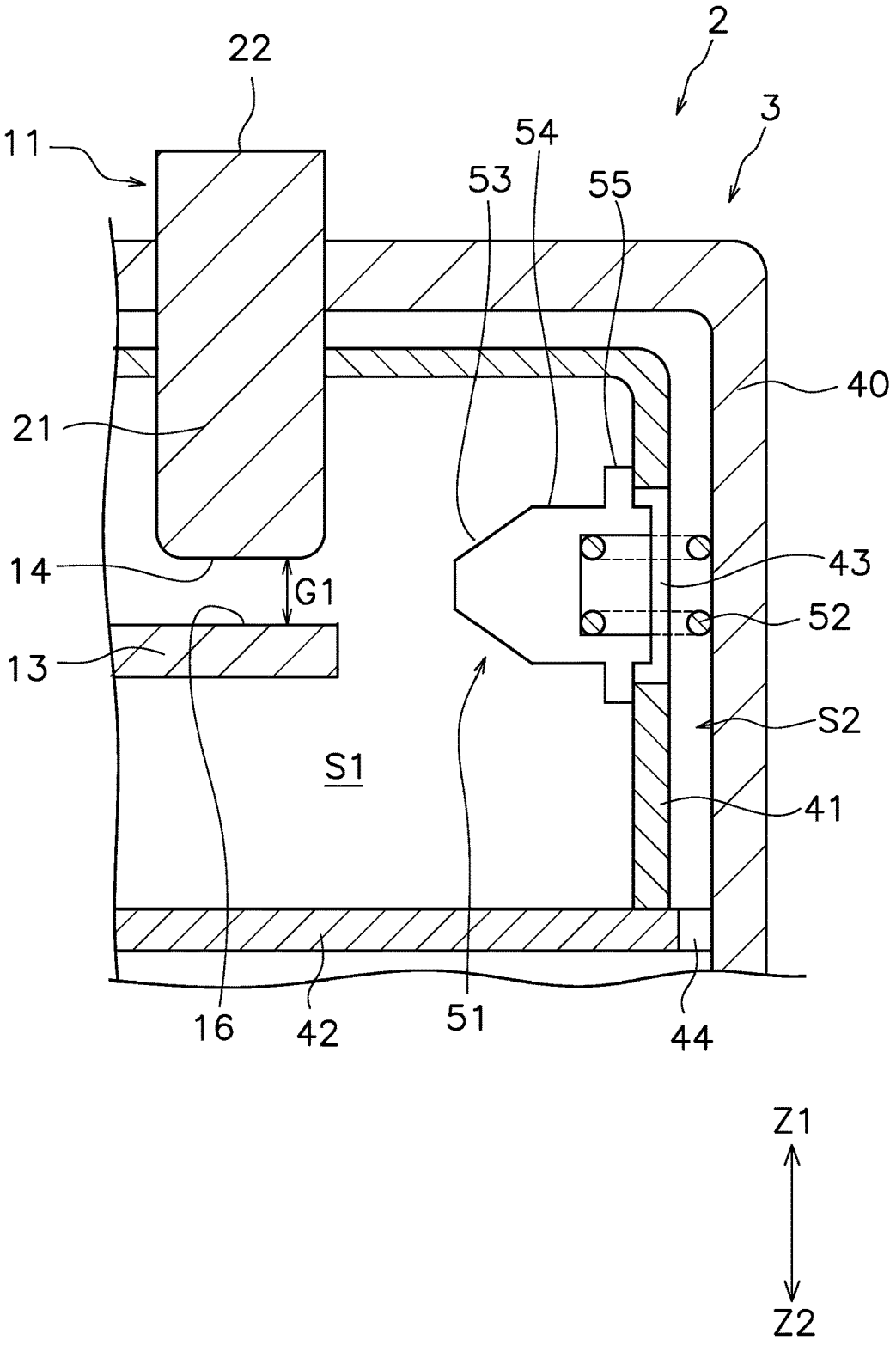
FIG. 4 is an enlarged view of the contact device.

The support member 52 movably supports the arc extinguishing member 51 with respect to the first hole 43. The support member 52 is connected to the housing 3 and the arc extinguishing member 51. The support member 52 is a coil spring and has a spring property. The support member 52 movably supports the arc extinguishing member 51 between the open position illustrated in FIG. 3 and the closed position illustrated in FIG. 4. As illustrated in FIG. 3, the arc extinguishing member 51 opens the first hole 43 at the open position. As illustrated in FIG. 4, the arc extinguishing member 51 closes the first hole 43 at the closed position. The support member 52 urges the arc extinguishing member 51 from the closed position to the open position.

Specifically, the arc extinguishing member 51 includes a tapered portion 53, a main body 54, and a flange portion 55. The tapered portion 53 is arranged to face the first gap G1. The tapered portion 53 has a shape that tapers toward the first gap G1. The main body 54 is supported by the support member 52. A part of the main body 54 is arranged in the first hole 43. The flange portion 55 projects from the main body 54. The outer shape of the flange portion 55 is larger than that of the first hole 43. As illustrated in FIG. 3, the first hole 43 is opened by separating the flange portion 55 from the first partition wall 41. As illustrated in FIG. 4, the first hole 43 is closed when the flange portion 55 contacts the first partition wall 41.

In the contact device 2 according to the present embodiment described above, when the breaking energy is small, metal vapor is discharged from the first space S1 through the first hole 43. Thereby, the insulation between the contacts can be improved. Further, when the breaking energy is large, the second hole 44 has the opening area smaller than that of the first hole 43, so that the metal vapor discharged from the first hole 43 and the arc extinguishing gas fill the second space S2. Therefore, the pressure in the first space S1 can be maintained high. Thereby, the arc can be extinguished more quickly. As described above, in the contact device 2 according to the present embodiment, the environment in the first space S1 in which the contacts are housed can be suitably adjusted according to the magnitude of the breaking energy.

Further, the first hole 43 is opened and closed by the arc extinguishing member 51 according to the magnitude of the breaking energy. When the breaking energy is small, the arc extinguishing member 51 is held in the open position by the urging force of the support member 52. Therefore, when the first hole 43 is opened, the metal vapor is discharged from the first hole 43. When the breaking energy is large, the pressure in the first space S1 causes the arc extinguishing member 51 to move to the closed position against the urging force of the support member 52. As a result, the pressure in the first space S1 can be maintained high by closing the first hole 43.

The arc extinguishing member 51 is arranged to face the first gap G1 when the first movable contact 16 is at the open position. Therefore, by arranging the arc extinguishing member 51 close to the first movable contact 16, the arc extinguishing gas can be generated near the first movable contact 16. Thereby, the arc extinguishing performance can be improved. Further, when the breaking energy is large, the arc extinguishing member 51 moves, so that the space between the arc extinguishing member 51 and the first movable contact 16 can be widened. As a result, even if the arc extinguishing member 51 is arranged close to the first movable contact 16, it is possible to prevent the arc from staying between the first movable contact 16 and the arc extinguishing member 51. Thereby, the arc can be extinguished quickly.

Although one embodiment of the present invention has been described above, the present invention is not limited to the above embodiment, and various modifications can be made without departing from the gist of the invention. For example, the contact device is not limited to a relay, and may be used for, for example, a breaker, a switch, or the like.

In the above embodiment, the drive device 4 pushes the drive shaft 19 from the drive device 4 side, so that the movable contact piece 13 moves in the contact direction Z1. Further, when the drive device 4 pulls the drive shaft 19 toward the drive device 4, the movable contact piece 13 moves in the separation direction Z2. However, the operating direction of the drive shaft 19 for opening and closing the contacts may be opposite to that of the above embodiment. That is, the movable contact piece 13 may move in the contact direction Z1 by pulling the drive shaft 19 toward the drive device 4. The movable contact piece 13 may move in the separation direction Z2 by pushing the drive shaft 19 from the drive device 4 side by the drive device 4. That is, the contact direction Z1 and the separation direction Z2 may be opposite to those of the above embodiment.

Figure 5:
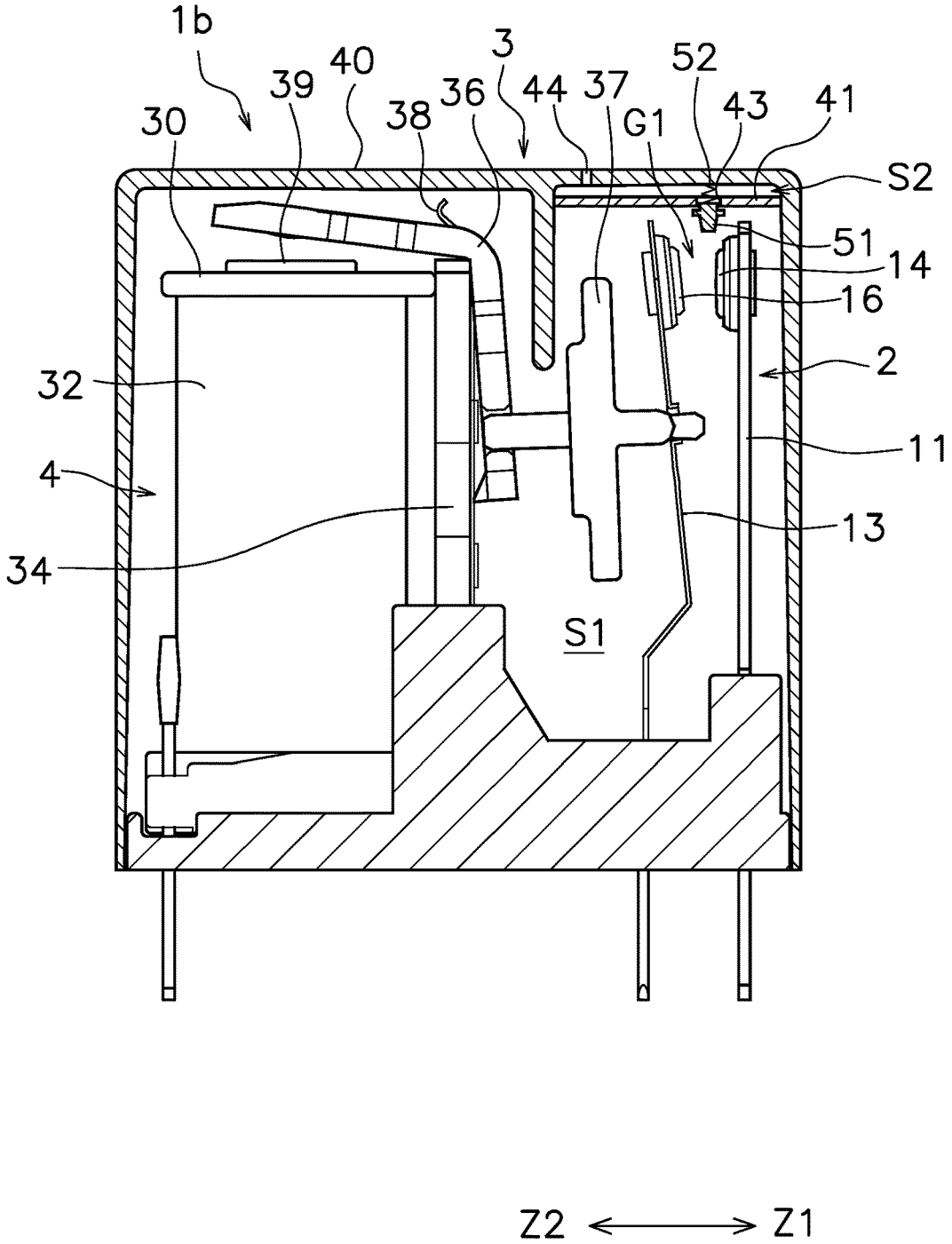
FIG. 5 is a side sectional view of a relay according to another embodiment.

The relay 1*a* described above is a so-called plunger relay, but the present invention may be applied to another type of relay, instead of the plunger relay. For example, as illustrated in FIG. 5, the present invention may be applied to a hinged relay 1*b*. In FIG. 5, the same reference numerals are given to the configurations corresponding to the configurations of the above-described embodiments.

In the hinged relay 1*b* illustrated in FIG. 5, when the coil 32 is magnetized, an armature 36 is attracted to the iron core 39 by the magnetic force of the coil 32 and swings. A card 37 is connected to the armature 36. When the card 37 presses the movable contact piece 13 in response to the swing of the armature 36, the movable contact piece 13 and the movable contact 16 move in the contact direction Z1. As a result, the movable contact 16 contacts the fixed contact 14. When the coil 32 is demagnetized, the armature 36 swings in the opposite direction due to the elastic force of the hinge spring 38. As a result, the card 37, the movable contact piece 13, and the movable contact 16 move in the separation direction Z2, and the movable contact 16 is separated from the fixed contact 14.

The inside of the housing 3 of the relay 1*b* is divided into a first space S1 and a second space S2 by a partition wall 41. The partition wall 41 is provided with a first hole 43. The case 40 is provided with a second hole 44. The second hole 44 has an opening area smaller than that of the first hole 43. The arc extinguishing member 51 is arranged to face the gap G1 between the movable contact 16 and the fixed contact 14. The arc extinguishing member 51 is movably supported by the support member 52. The arc extinguishing member 51 is configured to open and close the first hole 43. Even in such the hinge type relay 1*b*, the same effect as that of the relay 1*a* according to the above-described embodiment can be obtained.

The shapes or arrangements of the first fixed terminal 11, the second fixed terminal 12, and the movable contact piece 13 may be changed. The shape or arrangement of the coil 32, the spool 30, or the yoke 34 may be changed. The shapes or arrangements of the first fixed contact 14, the second fixed contact 15, the first movable contact 16, and the first fixed contact 14 may be changed.

The first fixed contact 14 may be provided separately from the first fixed terminal 11 or may be integrated with the first fixed terminal 11. The second fixed contact 15 may be provided separately from or integrated with the second fixed terminal 12. The first movable contact 16 may be provided separately from the movable contact piece 13, or may be integrated with the movable contact piece 13. The second movable contact 17 may be provided separately from the movable contact piece 13, or may be integrated with the movable contact piece 13.

Figure 6:
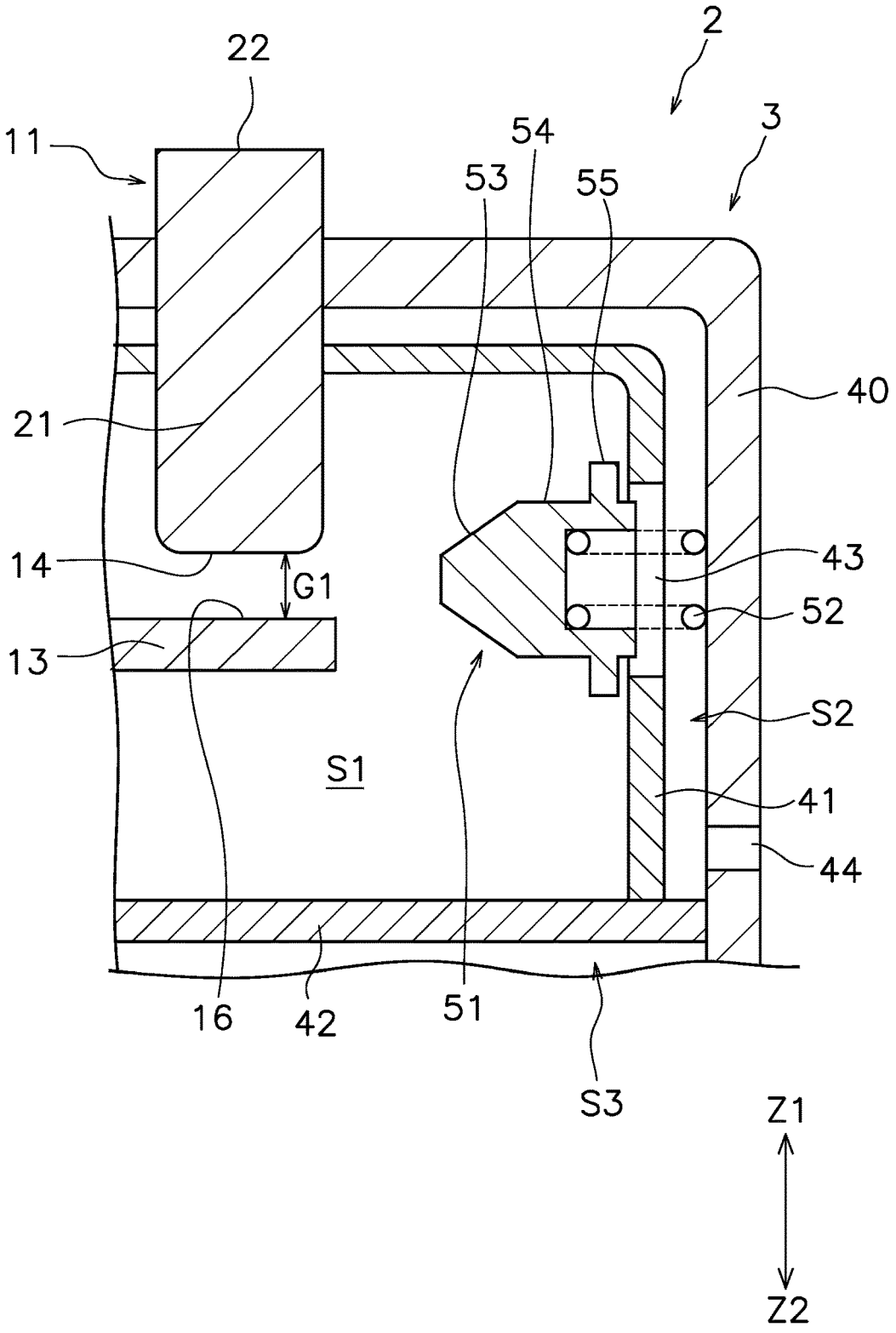
FIG. 6 is a diagram showing a contact device according to a first modification.

The arrangement of the first hole 43 and/or the second hole 44 is not limited to that of the above embodiment, and may be changed. For example, FIG. 6 is a diagram showing a contact device 2 according to the first modification. As illustrated in FIG. 6, the second hole 44 may be provided in the case 40. The second hole 44 may communicate the second space S2 with a space outside the second space S2. Specifically, the second hole 44 may communicate the second space S2 with the space outside the housing 3.

Figure 7:
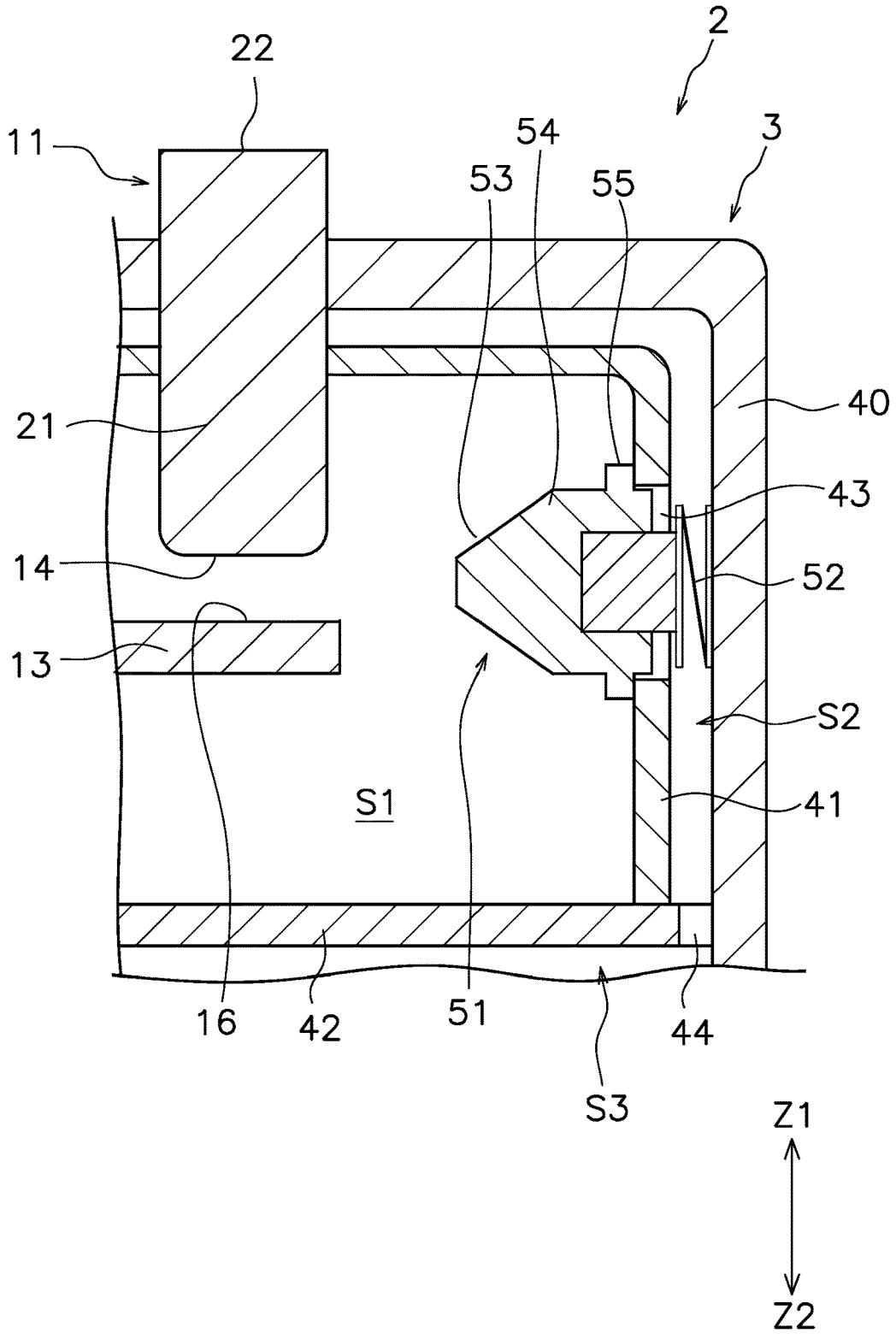
FIG. 7 is a diagram showing a contact device according to a second modification.

The support member 52 is not limited to the coil spring, and may have other shapes. For example, FIG. 7 is a diagram showing a contact device 2 according to a second modification. As illustrated in FIG. 7, the support member 52 may be a leaf spring. Alternatively, the support member 52 may have a structure other than the spring as long as it has a structure that movably supports the arc extinguishing member 51.

Figure 8:
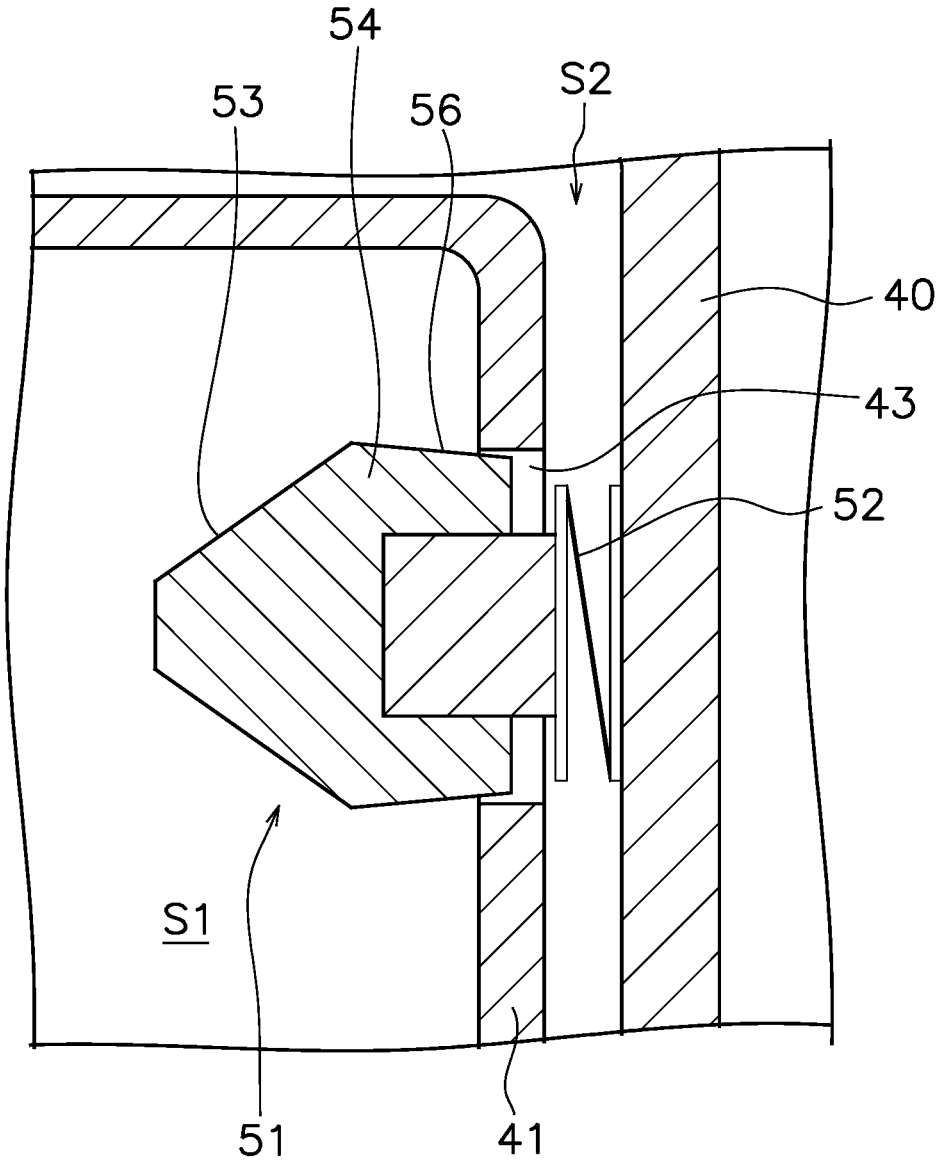
FIG. 8 is a diagram showing a contact device according to a third modification.

The shape and/or arrangement of the arc extinguishing member 51 is not limited to that described above, and may be changed. For example, FIG. 8 is a diagram showing a contact device 2 according to a third modification. As illustrated in FIG. 8, the arc extinguishing member 51 may include a tapered portion 56. A part of the tapered portion 56 is arranged in the first hole 43. The tapered portion 56 has a shape that tapers toward the first hole 43. The smallest outer shape of the tapered portion 56 is smaller than the first hole 43. The largest outer shape of the tapered portion 56 is larger than the first hole 43.

Figure 9A:
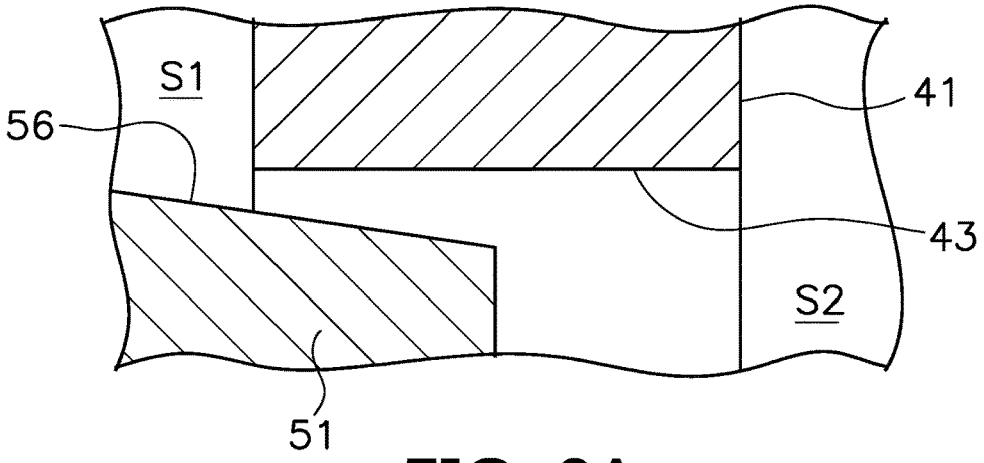
FIGS. 9A, 9B, and 9C are diagrams showing a contact device according to a third modification.
Figure 9B:
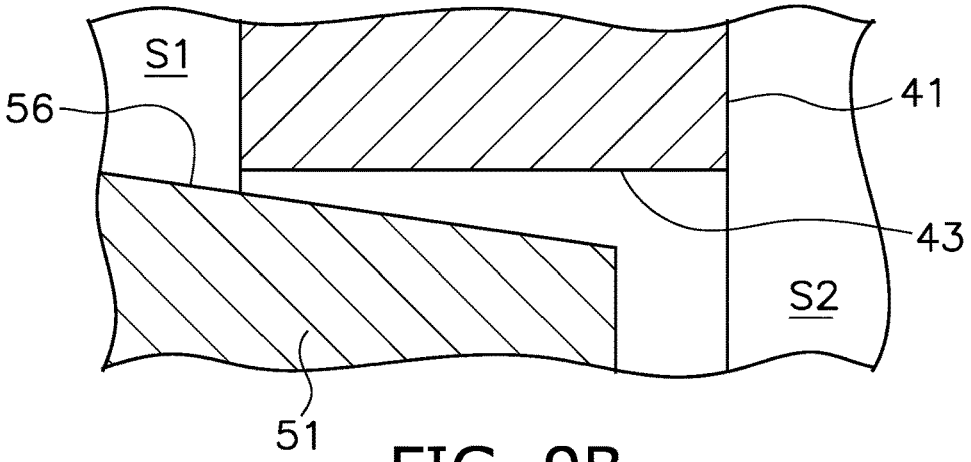
Figure 9C:
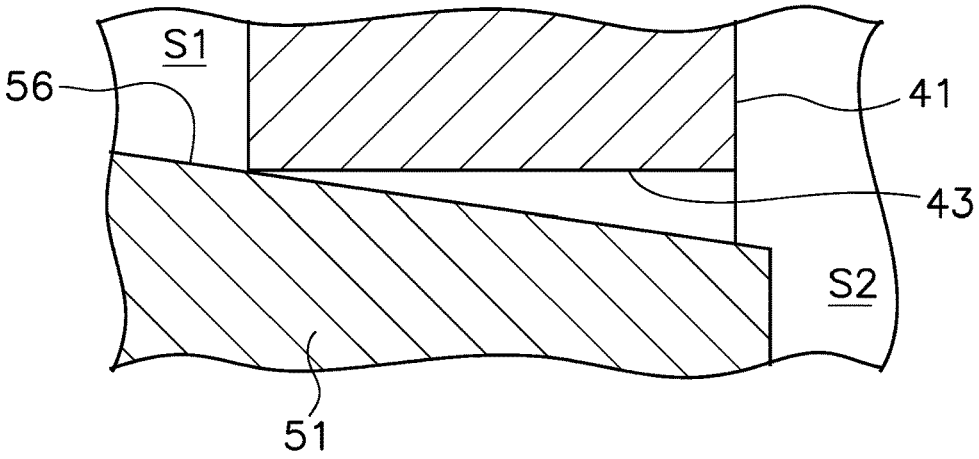

As illustrated in FIG. 9A, when the arc extinguishing member 51 is in the open position, the tapered portion 56 is separated from the edge of the first hole 43, and the first hole 43 is opened. When the pressure in the first space S1 rises, as illustrated in FIG. 9B, the tapered portion 56 of the arc extinguishing member 51 moves toward the first hole 43. As a result, the gap between the first hole 43 and the tapered portion 56 is narrowed. That is, the opening degree of the first hole 43 becomes smaller. When the pressure in the first space S1 further increases, as illustrated in FIG. 9C, the tapered portion 56 of the arc extinguishing member 51 contacts the edge of the first hole 43. As a result, the first hole 43 is closed. On the contrary, when the pressure in the first space S1 decreases, the tapered portion 56 of the arc extinguishing member 51 moves in the direction away from the first hole 43, and the gap between the first hole 43 and the tapered portion 56 becomes large. That is, the opening degree of the first hole 43 becomes large. In this way, the arc extinguishing member 51 may change the opening degree of the first hole 43 according to the pressure in the first space S1.

Figure 10:
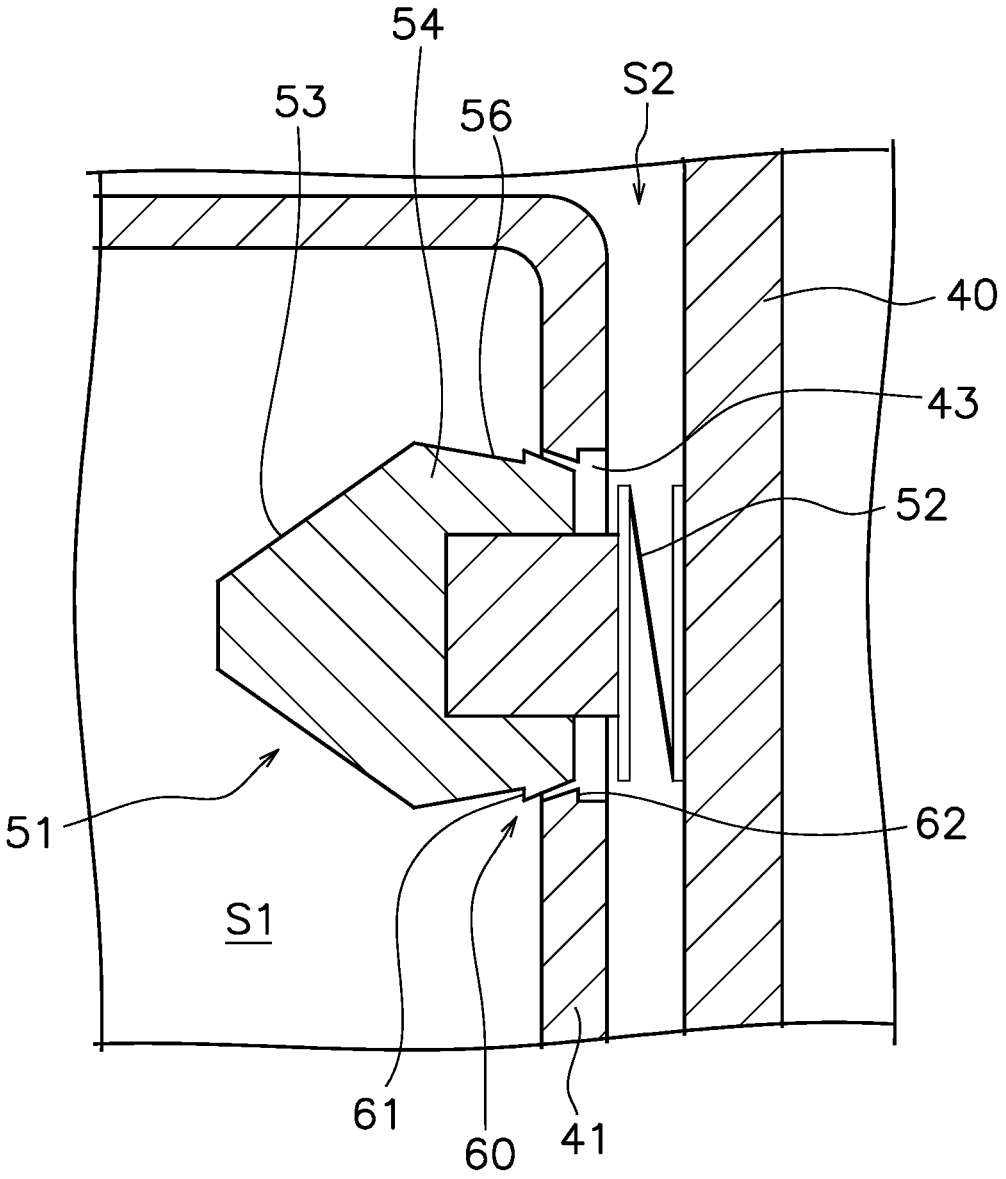
FIG. 10 is a diagram showing a contact device according to a fourth modification.

FIG. 10 is a diagram showing a contact device 2 according to a fourth modification. As illustrated in FIG. 10, the contact device 2 may include a holding mechanism 60. The holding mechanism 60 holds the arc extinguishing member 51 in the closed position. The holding mechanism 60 includes a locking portion 61 and a locked portion 62. The locking portion 61 is provided on the arc extinguishing member 51. The locking portion 61 projects from the surface of the arc extinguishing member 51. The locked portion 62 is provided on the first partition wall 41. The locked portion 62 projects from the inner peripheral surface of the first hole 43. When the arc extinguishing member 51 moves to the closed position, the locking portion 61 is locked to the locked portion 62. As a result, the arc extinguishing member 51 is held in the closed position.

Figure 11:
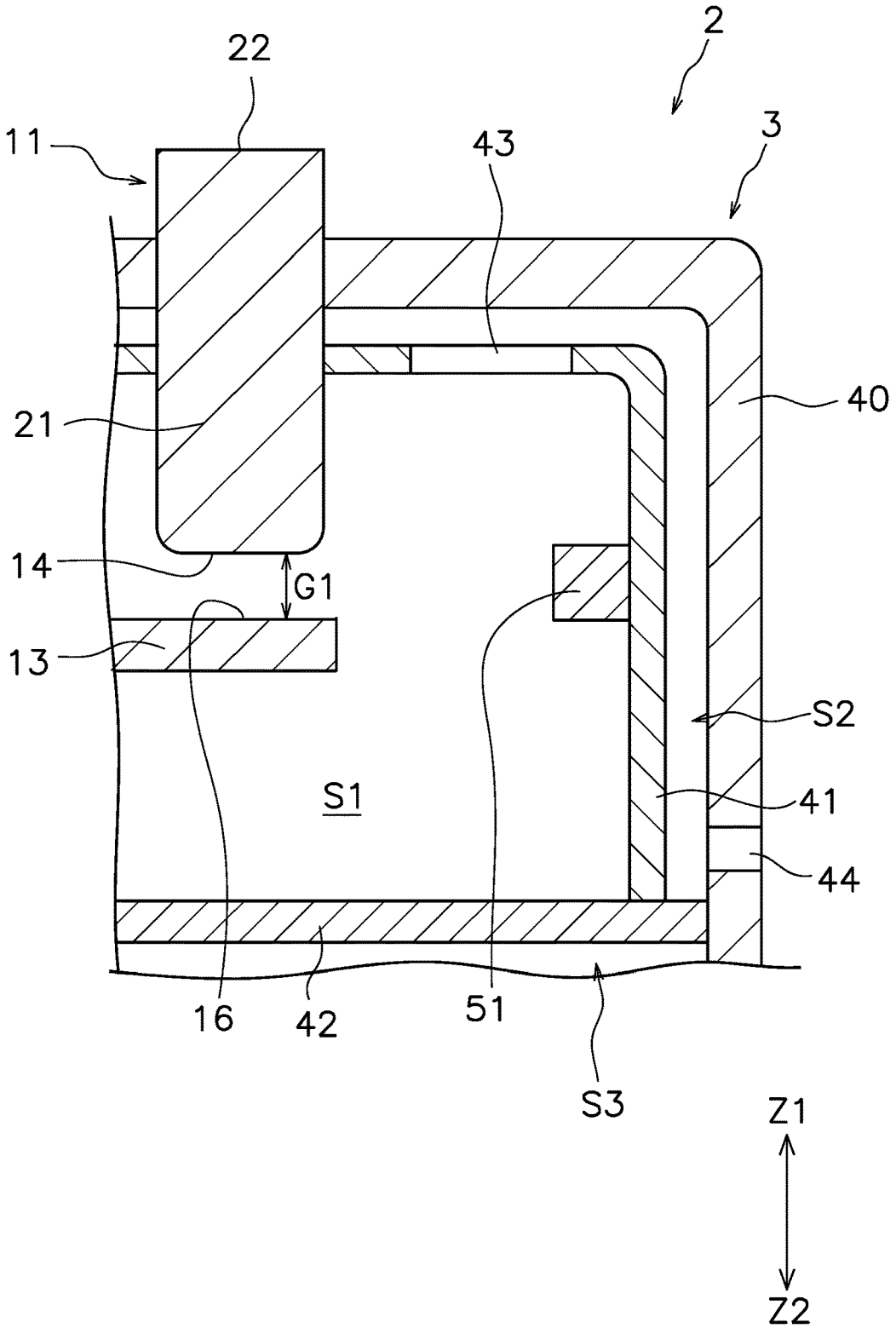
FIG. 11 is a diagram showing a contact device according to a fifth modification.

FIG. 11 is a diagram showing a contact device 2 according to a fifth modification. As illustrated in FIG. 11, the arc extinguishing member 51 may be arranged at a position different from that of the first hole 43. Alternatively, the first partition wall 41 may be formed of an arc extinguishing member.

Figure 12:
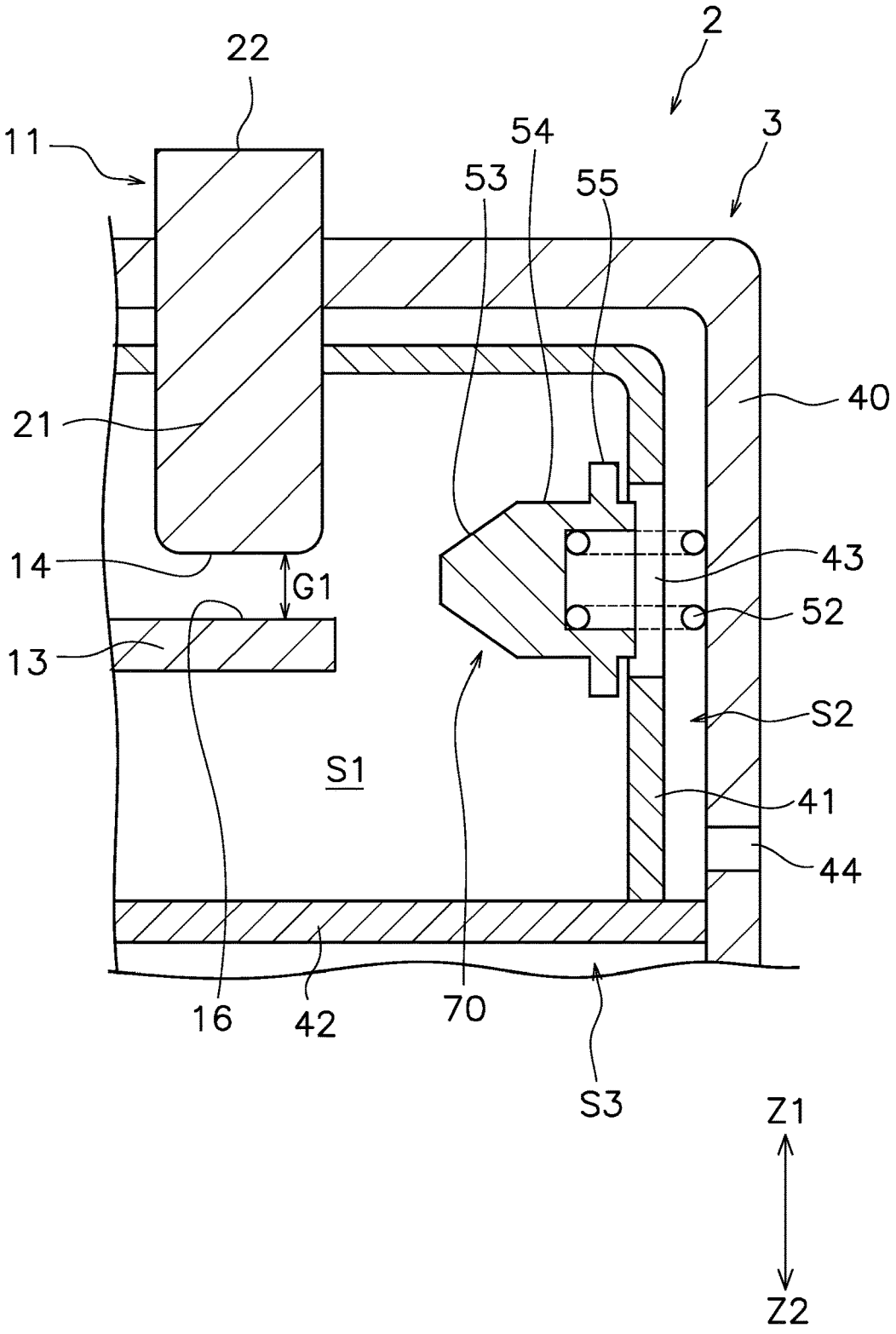
FIG. 12 is a diagram showing a contact device according to a sixth modification.

FIG. 12 is a diagram showing a contact device 2 according to a sixth modification. As illustrated in FIG. 12, the contact device 2 may include a valve body 70 instead of the arc extinguishing member 51 described above. The structure of the valve body 70 may be the same as that of the arc extinguishing member 51 according to the above-described embodiment or modification. For example, the valve body 70 is configured to open and close the first hole 43, similarly to the arc extinguishing member 51 described above. The valve body 70 may be made of a material that does not emit arc extinguishing gas. In FIG. 12, the same reference numerals are given to the configurations corresponding to the configurations of the arc extinguishing member 51 in the valve body 70. In this case, the arc extinguishing member 51 is arranged at a position different from that of the valve body 70. Alternatively, the first partition wall 41 may be made of a material that emits an arc extinguishing gas. That is, a part of the first partition wall 41 may be an arc extinguishing member. Alternatively, the entire first partition wall 41 may be an arc extinguishing member.

REFERENCE SIGNS LIST

3 Housing
14, 15 Fixed contacts
16, 17 Movable contacts
43 First hole
44 Second hole
51 Arc extinguishing member
52 Support member
56 Tapered portion
60 Holding mechanism
70 Valve body
S1 First space
S2 Second space

The invention claimed is:

1. A contact device, comprising:
a fixed contact;
a movable contact configured to move between a contact position where the movable contact contacts the fixed contact and a separate position where the movable contact is separated from the fixed contact; and
a housing including
a first space in which the fixed contact and the movable contact are disposed,
a second space partitioned from the first space,
a first hole that communicates the first space and the second space, and
a second hole that communicates the second space with a space outside the second space, the second hole having a smaller opening area than the first hole, and
an arc extinguishing member configured to discharge an arc extinguishing gas into the first space, the arc extinguishing member being further configured and arranged to open and close the first hole.

2. The contact device according to claim 1, further comprising:
a support member configured to support the arc extinguishing member movably with respect to the first hole.

3. The contact device according to claim 2, wherein the support member has a spring property.

4. The contact device according to claim 3, wherein the support member is further configured to urge the arc extinguishing member from a closed position at which the first hole is closed toward an open position at which the first hole is opened.

5. The contact device according to claim 4, further comprising:

a holding mechanism configured to hold the arc extinguishing member in the closed position.

6. The contact device according to claim 1, wherein the arc extinguishing member is further configured to change an opening degree of the first hole according to pressure in the first space.

7. The contact device according to claim 1, wherein the arc extinguishing member includes a tapered portion at least partially arranged in the first hole.

8. The contact device according to claim 1, wherein the arc extinguishing member is arranged to face a gap between the movable contact and the fixed contact in a state where the movable contact is in the separate position.

9. The contact device according to claim 1, wherein the housing includes a partition wall that partitions the first space, and the arc extinguishing member forms at least a part of the partition wall.

* * * * *